United States Patent [19]

Lopez et al.

[11] 4,105,113

[45] Aug. 8, 1978

[54] SAFETY MATCHPACKET COVER TO PREVENT CHILDREN FROM USING ANY MATCH

[76] Inventors: Tiburcio Coria Lopez; Yolanda Teevin Coria, both of Jackson Heights, N.Y.

[21] Appl. No.: 705,331

[22] Filed: Jul. 19, 1976

[51] Int. Cl.[2] ..... A24F 27/00

[52] U.S. Cl. ..... 206/100; 206/107; 206/805

[58] Field of Search ..... 206/96, 98–100, 206/106–107, 110, 115, 805

[56] References Cited

U.S. PATENT DOCUMENTS

| | | | |
|---|---|---|---|
| 233,803 | 10/1880 | Riedel et al. | 206/98 |
| 1,066,311 | 7/1913 | O'Malley | 206/96 |
| 2,084,706 | 6/1937 | Pullen | 206/98 X |
| 2,405,865 | 8/1946 | Watkins | 206/98 |

FOREIGN PATENT DOCUMENTS

| | | | |
|---|---|---|---|
| 24,972 | 1883 | Fed. Rep. of Germany | 206/100 |

*Primary Examiner*—Steven E. Lipman

[57] ABSTRACT

A safety matchpacket cover to prevent children from using any match, the device comprising a paperboard, plastic, metal or wood plate with lateral grooved guides to slide in same cover or dispenser a safe from burns and waterproof matchpacket, the device also comprising an elastic cord or rubber band that retracts the matchpacket back to its enhoused original position in the matchpacket cover or dispenser, and primarily comprising a concealed lock that prevents matches to be withdrawn from dispenser or matchpacket cover, unless unlocking the matchpacket. This concealed and unperceptable lock is effective and strong enough to prevent children and infants from releasing and lighting matches and eventually producing fires at home when same children or infants are alone.

1 Claim, 7 Drawing Figures

SAFETY MATCHPACKET COVER TO PREVENT CHILDREN FROM USING ANY MATCH

Figure 1:
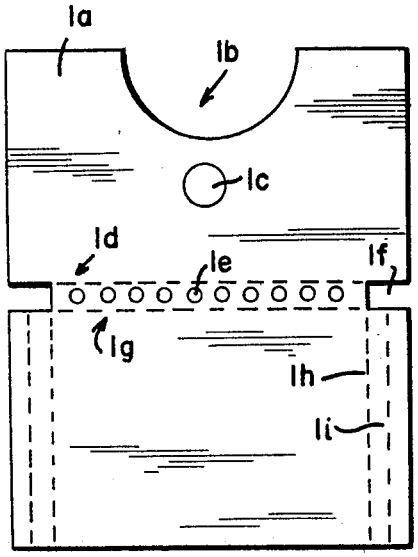

This invention relates in general to safety dispensers for matches.

A principal object of the present invention is to make it possible to produce in large scale mass production a disposable match enhoused in a safety matchpacket cover, avoiding the bending of the match sticks when the matchpacket is not in use, retracting automatically the matchpacket after each match has been lighed, concealing the match sticks from the sight of children or infants and mainly locking same matchpacket in its cover by using an unperceptable lock which tightens the matchpacket inside the cover and preventing children from using and lighting matches at home.

Another object is to provide a safety matchpacket cover to receive a match comb not naked as it is done up to this date by the match industry, but enhoused same match comb in paper or paperboard to avoid friction between match heads as it happens at the present time in the regular bookmatches that contain naked match combs. This enhoused match combs can be assembled into the safety matchpacket cover automatically and at high speed as it is done now by the electric stapling machines in the match industry, making it possible to use a safe from burns and waterproof match automatically and instantly only by adults.

Yet another object of this invention is to promote and increase the consumption of matches by using safety and safe from burns and waterproof match packets, at a very slightly increased price against the standard regular bookmatches used at the present time. This new safety matchpacket cover has wide space for advertisements.

Other object is to provide an extraflat safety dispenser or cover for waterproof and safe from burns matchpackets, which does not take space in the pockets of its user. Also same safety matchpacket covers can be made of double capacity of matches by adhering two match covers containing 10 lights each to make a match dispenser or matchpacket cover to retain 20 lights as it is done now; but the use of a 10 matches safety match dispenser or cover offers the great advantage to the industrial producers to increase profits due to the fact that when double quantity of match packets are in circulation, double quantity of readers will see the adds printed in same safety matchpacket covers.

Yet another object is to be able to use safe from burns and waterproof match refills or enhoused match combs in this new safety matchpacket covers or dispensers with the match heads of same enhoused match combs that contain chemical extracts of perfumes that when matches are lighted will spread a perfumed aroma instead of an unpleasant smelling of sulphur as it happens at the present time with the regular conventional bookmatches used up to this date. The spreading of perfumed aroma will also be a strong factor to increase the sales of this new safety matchpacket cover.

These perfumed matches can only be produced using the safe from burns and waterproof match packets in view of the fact that due to its hermetic sealed cells made of vinyl in these waterproof match packets, the perfume essence is indefinitely retained precisely because of is hermetic means. In the regular conventional bookmatches the use of perfume extracts has not been made possible due to the fact that perfume extracts are volatile and therefore evaporate because the matches are now naked and not enhoused as it happens in the safe from burns and waterproof match packets. These hermetic and safe from burns and waterproof match packets are as of this date covered by U.S. Pat. No. 3,561,590 issued on Feb. 9, 1971 and which invention belongs to the undersigned, Tiburcio Coria Lopez.

Figure 4:
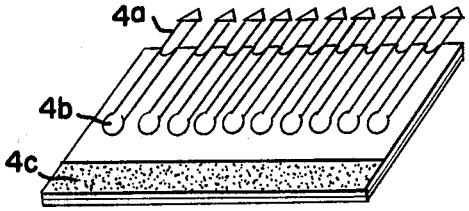
Figure 5:
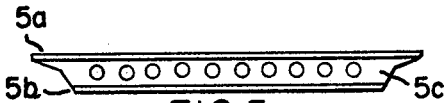
Figure 6:
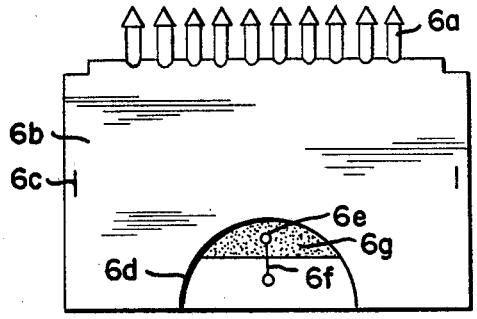
Figure 2:
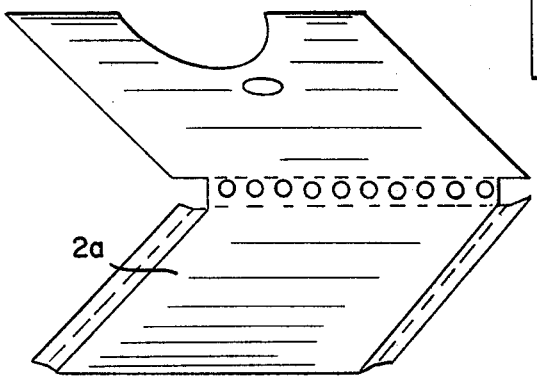
Figure 7:
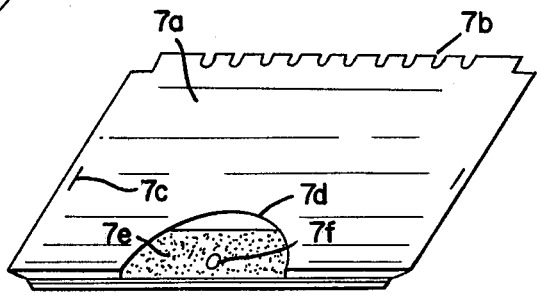
Figure 3:
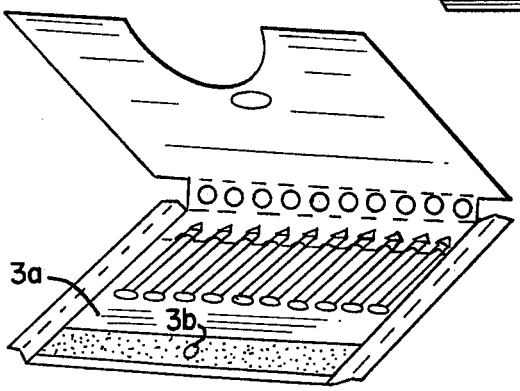

These and other objects will be readily evident upon a study of the following specification and the accompanying drawings wherein:

FIG. 1 is a top view of an unfolded matchpacket cover or dispenser,

FIG. 2 is a transversal view of a matchpacket cover without the matchpacket, FIG. 3 is a transversal view of the matchpacket cover placed in the bottom portion, FIG. 4 is the waterproof matchpacket, FIG. 5 is a closed covered without a matchpacket inside of the matchpacket cover, FIG. 6 is a view of the matchpacket cover with the match sticks of the matchpacket exposed, and FIG. 7 is a top view of the matchpacket cover showing the matchpacket in the retracted position.

FIG. 1 is a top view of an unfolded matchpacket cover or dispenser in which 1-*a* is the top cover portion; 1-*b* is the diecutted window made in the form of semicircle and which later when matchpacket cover is assembled will allow the sliding of the thumb finger to push matchpacket through; 1-*c* is a circular adhesive disc unvisible in the outside of cover and which will be used as lock; 1-*d* describes small perforated line which will easy the folding of the cover when assembled; 1-*e* are the die-cutted punched holes that will serve later to receive the match sticks through when matchpacket is slided through; 1-*f* is a die-cutted window that will be used to easy the automatic folding of the cover when in the process of assembled by machine at high speed in mass production; 1-*g*, 1-*h* and 1-*i* are very small perforations in line to easy the assembling of the matchpacket cover or dispenser.

FIG. 2 is a transversal view of a matchpacket cover in an open position and without the matchpacket. FIG. 2-*a* is the area in the matchpacket cover where the matchpacket will be placed automatically when matchpacket cover is assembled.

FIG. 3 is a transversal view of the matchpacket cover or dispenser with the safe from burns and waterproof match packet already placed in the bottom portion of the matchpacket cover wherein FIG. 3-*a* is the matchpacket itself and FIG. 3-*b* is the small perforation through which the elastic cord or rubber band will pass to produce a retraction force when the match packet is slided through the circled perforations.

FIG. 4 is the hermetically sealed and safe from burns and waterproof matchpacket, wherein 4-*a* are the match sticks; 4-*b* are the match heads areas and 4-*c* is the ignition striking band in the safe from burns and waterproof match packet, which can be used if so desired, in which case the match will be withdrawn slowly to get an unlighted match and to light it in the same old-fashioned style, in other striking same match unlighted against the Ignition Striking band to ignite it. When matches are withdrawn quickly as normally done the matches come out already ignited.

FIG. 5 is a top view of the matchpacket cover already assembled wherein 5-*a* is the top portion of the cover; 5-*b* is the bottom portion of the cover and 5-*c* are the circle perforations through which the matches are withdrawn. This FIG. 5 comprises a closed cover but unloaded, in other words without matchpacket inside of the matchpacket cover.

FIG. 6 is top view of closed matchpacket cover, wherein 6-*a* show the match sticks; 6-*b* the top portion of the matchpacket cover; 6-*c* the staples after matchpacket cover is assembled; 6-*d* the die-cutted window through which the thumb finger will be slided to push the matchpacket. In this Figure the matchpacket is slided in its entirety and the match sticks can be seen out of the matchpacket cover; 6-*e* is the perforation through which can be seen the elastic cord in a tension position; 6-*f* is the elastic cord itself which is also attached to the bottom portion of the matchpacket cover; 6-*g* is a portion of the ignition striking band where eventually can the unlighted matches be striken if so desired. When thumb finger is released from this die-cutted window of matchpacket cover, the retracting force of the elastic cord or rubber band and which in this Figure is shown as 6-*f*, brings back matchpacket to its original position and therefore automatically hiddens the match sticks inside the matchpacket cover, out of sight from the children. The adhesive disc which cannot be seen in this figure but which is placed underneath of cover, right over the striking ignition band, if pressed down against the matchpacket it will seal temporarily the matchpacket cover against the matchpacket. When thumb finger is pushed through the die-cutted window of cover the sealing made by the adhesive disc shown in FIG. 1-*c* is released and the matchpacket can run freely to make available the match sticks for its withdrawal, automatically ignited.

FIG. 7 is a transversal top view of the matchpacket cover in a closed position, wherein 7-*a* is the top portion of cover; 7-*b* is a partial view of the circular perforations through which the match sticks will come through; 7-*c* is the left side staple that is placed by machine automatically when matchpacket cover is assembled also by machine at high speed to make this matchpacket cover mass production and at very low and competitive price, very slightly higher than the cost of the conventional bookmatches which do not offer any safety whatsoever up to this date; 7-*d* is the die-cutted window through which in this figure it can be seen the matchpacket already retracted to its original position, allowing to see the ignition striking band and the perforation where the elastic cord is attached to the bottom of the matchpacket cover; 7-*e* is the ignition striking band itself and finally 7-*f* is the perforation of the matchpacket that holds attached the elastic cord against the bottom portion of the cover.

While various changes can be made in the detailed construction of this matchpacket cover or dispenser, it is understood that same changes will be within the spirit and scope of the present invention.

We claim:

1. In a match holder comprising a plurality of watertight cells each housing the substantial part of the length of a match therein, ignition means within each cell for automatically igniting a match upon the withdrawal thereof, a first cover member holding said plurality of cells in place, a polyethylene coating around the edges of said first cover member hermetically sealing said plurality of cells and insulating each of the cells from moisture and preventing sparks from exiting the cells upon ignition of a match; the improvement comprising completely enclosing said match holder in a second cover member, said second cover member including a top portion and a pair of cover portions hingedly attached to opposite sides of said top portion, one of said cover portions having a plurality of foldably connected flaps on opposed side edges thereof an the other cover portion having a finger notch therein in an edge opposite to the side connected to the top portion, an elastic member having one end thereof affixed to said one cover portion, a plurality of apertures located in said top portion in alignment with each one of said matches, said hingedly connected flaps being secured to said other cover portion to form said second cover member with said opposed cover portions being in substantial parallel relation, said match holder bein slideably received within said second cover member between said opposed cover portions with said matches in alignment with said apertures in the top portion, the other end of said elastic member being secured to said match holder so that when a user slidingly propels said match holder toward said top portion by digital access through said finger notch said matches will protrude through said apertures and, upon removal of the user's finger, the elastic member will cause the retraction of the match holder within the second cover member.

* * * * *